United States Patent [19]

Shikata

[11] 4,430,979

[45] Feb. 14, 1984

[54] AIR-FUEL RATIO CONTROL SYSTEM

[75] Inventor: Makoto Shikata, Musashimurayama, Japan

[73] Assignees: Fuji Jukogyo Kabushiki Kaisha, Tokyo; Nissan Motor Co., Yokohama, both of Japan

[21] Appl. No.: 174,375

[22] Filed: Aug. 1, 1980

[30] Foreign Application Priority Data

Aug. 2, 1979 [JP] Japan ..... 54-98920

[51] Int. Cl.[3] ..... F02B 3/00; F02M 7/00

[52] U.S. Cl. ..... 123/479; 123/489; 123/440

[58] Field of Search ..... 123/440, 489, 479

[56] References Cited

U.S. PATENT DOCUMENTS

| | | | |
|---|---|---|---|
| 4,143,623 | 3/1979 | Norimatsu | 123/440 |
| 4,173,952 | 11/1979 | Asano | 123/440 |
| 4,183,335 | 1/1980 | Asano | 123/440 |
| 4,202,301 | 5/1980 | Early | 123/440 |
| 4,265,208 | 5/1981 | Emmert | 123/440 |

*Primary Examiner*—Ronald B. Cox
*Attorney, Agent, or Firm*—Martin A. Farber

[57] ABSTRACT

A system for controlling air-fuel ratio for a carburetor for an internal combustion engine having an induction passage, a throttle valve, an exhaust passage, an exhaust gas detector such as oxygen sensor for detecting the concentration of oxygen in the exhaust gases, air-fuel mixture supply means, an on-off electromagnetic valve for correcting the air-fuel ratio of the air-fuel mixture supplied by the air-fuel mixture supply means and an electronic controller. The electronic controller comprises a comparing circuit for comparing the output signal of the detector with a stoichiometric reference, an integration circuit connected to the comparing circuit, a triangular wave pulse generator, and a driving circuit for producing square wave pulses for driving the on-off electromagnetic valve means from the output signal of the integration circuit and of the triangular wave pulse generator for controlling the air-fuel ratio to a value approximately equal to the stoichiometric air-fuel ratio. A constant signal generating circuit is selectively connected operatively to the electronic controller. An idling operation detector produces a signal during idling operation. A switching unit operatively connects the contant signal generating circuit to the electronic controller and renders the electronic control means non-responsive to the output of the exhaust gas detector. The switching unit is adapted to be operated only after a predetermined time delay when the duty ratio of the square wave pulses reaches the maximum or minimum value during the idling operation.

9 Claims, 6 Drawing Figures

AIR-FUEL RATIO CONTROL SYSTEM

BACKGROUND OF THE INVENTION

The present invention relates to a system for controlling air-fuel ratio for an internal combustion engine emission control system with a three-way catalyst, and more particularly to a system for controlling the air-fuel ratio in an unusual condition such as the malfunction of the carburetor.

Such a control system is a feedback control system, in which an oxygen sensor is provided to sense the oxygen concentration of the exhaust gases to generate an electrical signal as an indication of the air-fuel ratio of the burned air-fuel mixture.

The oxygen sensor generates a high voltage when the air-fuel ratio of the exhaust gases is smaller than the stoichiometric air-fuel ratio and generates a low voltage when the air-fuel ratio is greater than the stoichiometric ratio. The control system operates to correct the air-fuel ratio given by the carburetor to the stoichiometric air-fuel ratio in dependency upon the output voltage of the oxygen sensor. In such a control system, various control correction means are provided for fixing the air-fuel ratio to a predetermined constant value during an unusual condition. For example, if the idling operation of the engine continues for a long time, the temperature of the exhaust gases decreases, which causes a decrease in the temperature of the oxygen sensor body. When the temperature of the oxygen sensor body decreases, the output voltage of the sensor decreases. The voltage decrease is the same as when the air-fuel ratio of the exhaust gases becomes greater than the stoichiometric ratio. Thus, the feedback control system operates to actuate an air-fuel ratio correcting means, such as an electromagnetic valve, to correct the air-fuel ratio to a smaller air-fuel ratio. But such a correcting operation is also performed when the carburetor supplies a rich or stoichiometric air-fuel ratio mixture. As a result, the mixture induced in the engine is excessively enriched.

In order to prevent such as excessive enrichment of the mixture, the feedback system is constructed so as to actuate the air-fuel ratio correcting means at a predetermined constant duty ratio when an enrichment correction operation having a duty ratio greater than a predetermined ratio continues for a predetermined period. However, in such a system, if the carburetor malfunctions to supply a very lean mixture, the control system continues to enrich the air-fuel mixture at the minimum duty ratio. And if the enrichment control operation continues for the predetermined period, the feedback system is changed to the constant duty ratio, that is the predetermined greater duty ratio supply condition. As a result, a much leaner mixture is supplied. Such a lean mixture can cause malfunctioning of the engine.

SUMMARY OF THE INVENTION

The object of the present invention is to provide an air-fuel ratio control system in which the duty ratio of the air-fuel ratio correcting means is fixed to a predetermined value when a correcting operation at a predetermined excessive duty ratio occurs only during the idling operation of the engine to thereby prevent the supply of excessively rich or lean mixture.

According to the present invention, there is provided an air-fuel ratio control system for a carburetor of an internal combustion engine having an intake passage, a throttle valve in the intake passage, an exhaust passage, first detector for detecting the concentration of a constituent of exhaust gases passing through said exhaust passage, and on-off electromagnetic valve means for correcting the air-fuel ratio of the air-fuel mixture supplied by an air-fuel mixture supply means, the improvement comprising electronic control means comprising a comparator circuit means for comparing an output signal of said first detector means and a driving circuit for producing a driving output for driving said electromagnetic valve means dependency on an output signal of said comparing circuit means for controlling the air-fuel ratio to a value approximate to the stoichiometric air-fuel ratio, second detector means for detecting idling operation of said internal combustion engine and producing an idle detected signal during idling operation, constant signal generating circuit means when actuated for selectively operating said on-off electromagnetic valve means via said driving circuit at a predetermined pulse duty ratio, and switch means for rendering said electronic control means non-responsive to the output signal of said first detector means and responsive to the constant signal, and abnormal condition detecting circuit means responsive to an excessive output of said first detector means, the excessive output being detected when said concentration of the exhaust gases deviates excessively from the stoichiometric air-fuel ratio, and to said idle detected signal during the idling operation, said abnormal condition detecting circuit means including a delay circuit for generating signals for actuating said switch means during said excessive output of said first detector means when the excessive output continues for a predetermined period during the idling operation, so that the electronic control means is operated by the constant signal for further aggravating the deviation of the air-fuel ratio.

With the above and other objects and advantages in view, the present invention will become more clearly understood in connection with the detailed description of preferred embodiments, when considered with the accompanying drawings, of which:

DETAILED DESCRIPTION OF THE PREFERRED EMBODIMENT

Figure 1:
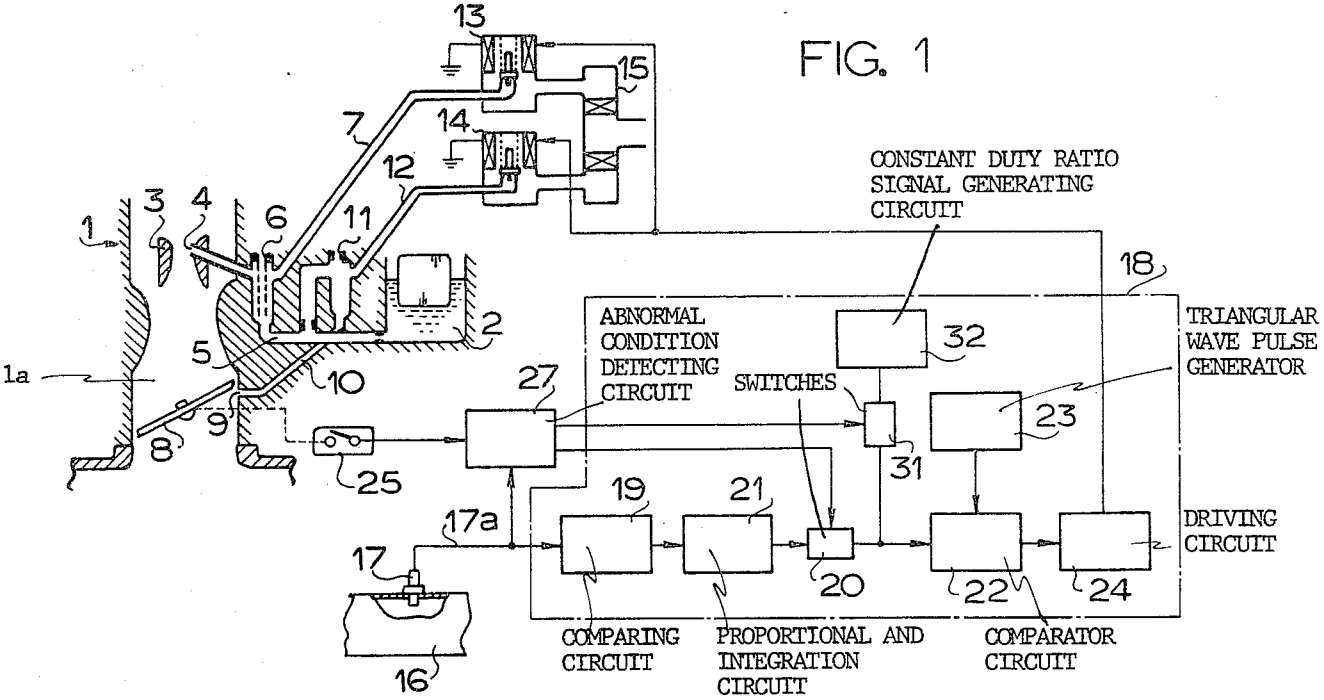
FIG. 1 is a schematic view of a system for controlling air-fuel ratio according to the present invention.

Referring to FIG. 1, a carburetor 1 communicates with an internal combustion engine (not shown). The carburetor comprises a float chamber 2, a venturi 3 formed in an intake passage 1*a*, a nozzle 4 communicating with the float chamber 2 through a main fuel passage 5, and a slow port 9 provided near the throttle valve 8 in the intake passage 1*a* and communicating with the float chamber 2 through a slow fuel passage 10. Air correcting passages 7 and 12 are provided in parallel to a main air bleed 6 and a slow air bleed 11, respectively. On-off electromagnetic valves 13 and 14 are provided for the air correcting passages 7 and 12, respectively. An inlet port of each on-off electromagnetic valve communicates with the atmosphere through an air filter 15. An oxygen sensor 17 is disposed in an exhaust pipe 16 downstream of the engine for detecting the oxygen concentration in the exhaust gases. A three-way catalytic converter (not shown) is provided in the exhaust pipe 16 downstream of the oxygen sensor 17.

Figure 2:
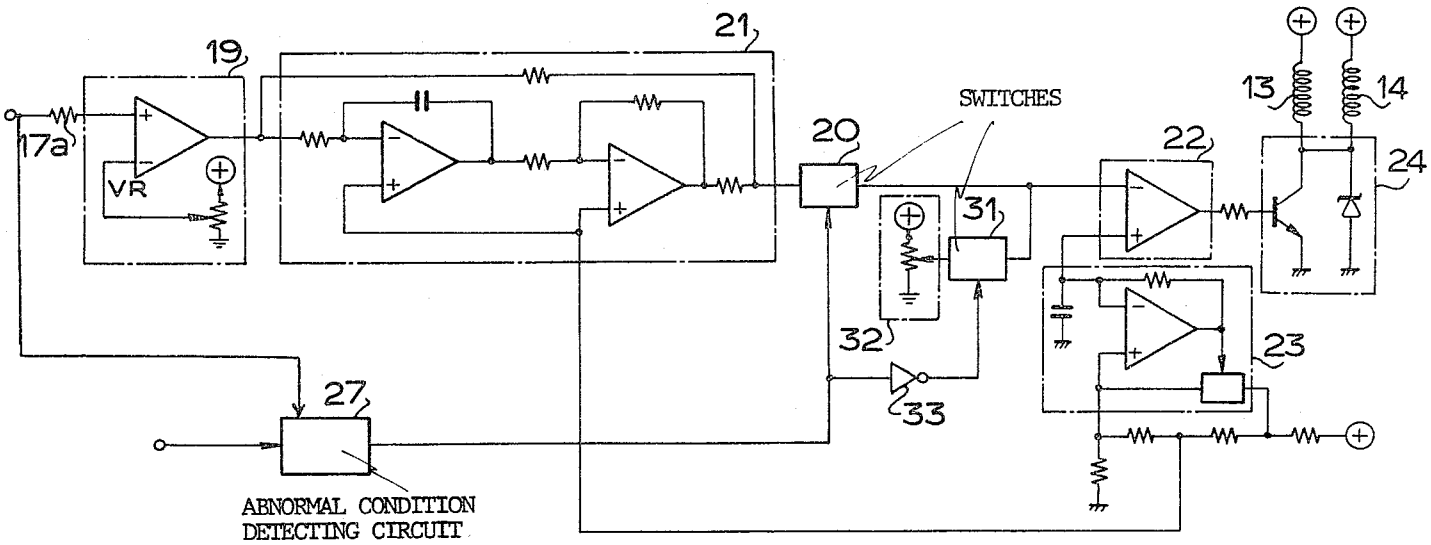
FIG. 2 is an electronic control circuit of FIG. 1.

The output signal of the oxygen sensor 17 is sent via line 17*a* to a comparing (comparator) circuit 19 of a feedback control circuit 18. The comparing circuit 19 compares the input signal from the oxygen sensor 17 with a reference value $V_R$ (FIG. 2) corresponding to the stoichiometric air-fuel ratio and determines whether the input signal is rich or lean compared with the reference stoichiometric ratio producing a comparing signal dependent on this comparison. This comparing signal is applied to a proportional and integration circuit 21, where the signal is converted to a proportional and integration signal which varies in an opposite direction to the direction represented by the comparing signal. The proportional and integration signal is fed to a comparator circuit 22 via a switch 20. The proportional and integration signal is compared with triangular wave pulses applied from a triangular wave pulse generator 23 so that square wave pulses are produced. The square wave pulses drive the on-off electromagnetic valves 13 and 14 via a driving circuit 24.

When a rich air-fuel ratio has been determined by the comparator circuit 19, the comparator circuit 22 produces output pulses having a greater pulse duty ratio, whereby the electromagnetic valves 13, 14 are opened for longer times and consequently the amount of air passing through the on-off electromagnetic valves 13 and 14 increases. Thus, the amount of air in the air-fuel mixture fed from the carburetor 1 increases, which thereby increases the air-fuel ratio. When a lean air-fuel ratio has been determined by the comparator 19, an output having a smaller pulse duty ratio is produced, whereby the air-fuel ratio is decreased to enrich the air-fuel mixture.

Figure 3:
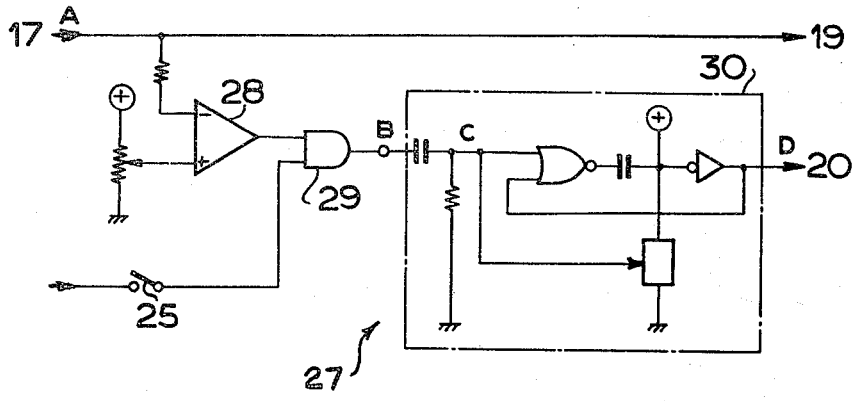
FIG. 3 is an abnormal condition detecting circuit.

In accordance with the present invention, an idling detecting switch 25 is operatively connected to the throttle valve 8. The switch 25 is closed when the throttle valve is in the idling position. The switch 25 is connected to an abnormal condition detecting circuit 27. As shown in FIG. 3, the abnormal condition detecting circuit comprises a comparator 28, an AND gate 29 and a retriggerable monostable multivibrator 30. The idling detecting switch 25 is connected to one of the inputs of the AND gate 29. On the other hand, the output of the oxygen sensor 17 is connected to the other input of the AND gate 29 through the comparator 28. The output of the retriggerable monostable multivibrator 30 is connected to the gate of the switch 20 and to the gate of a switch 31 provided between the comparator 22 and a constant duty ratio signal generating circuit 32 via an invertor 33 (see FIG. 2).

Figure 4:
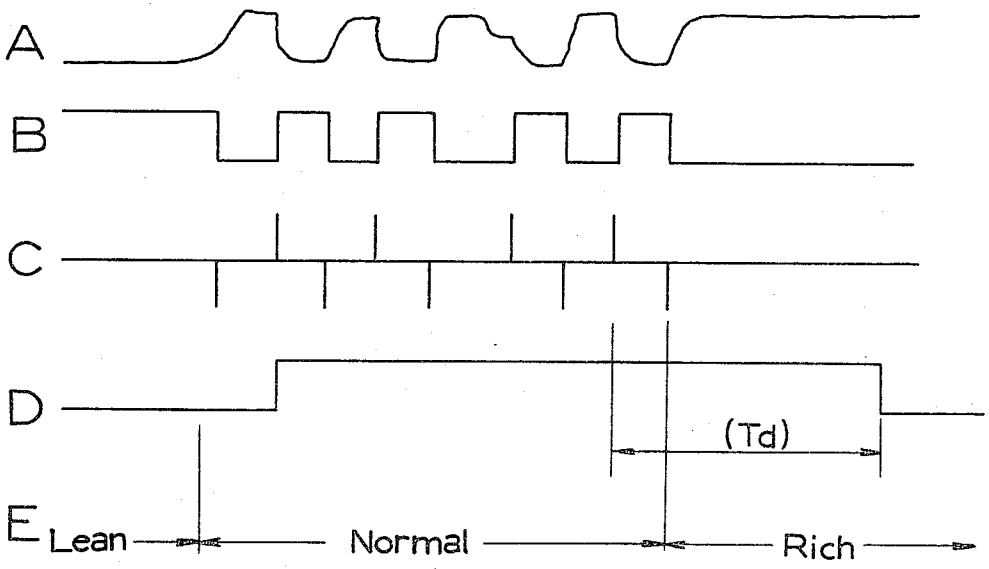
FIG. 4 shows waveforms at various locations in FIG. 3.

FIGS. 4(A) to (D) show waveforms at locations A to D in FIG. 3. In the idling condition, when the switch 25 is closed, if the output voltage of the oxygen sensor 17 is higher than a predetermined level, the output voltage B of the AND gate is at a low level. In the normal operating condition of the control system, the output voltage of the oxygen sensor 17 oscillates as shown in FIG. 4(A) and (E). Due to the series of input pulses (FIG. 4(C)), the output (FIG. 4(D)) of the multivibrator 30 maintains a high level voltage. The high level voltage is applied to the gates of the switches 20 and 31, so that the switch 20 is closed and the switch 31 is opened. This is a normal control condition.

If the output voltage of the oxygen sensor 17 continues higher than the predetermined level for a predetermined period, which means an abnormal condition, the output voltage of the monostable 30 changes to a low level after a predetermined time delay (Td) as shown in FIG. 4(D). Thus, the switch 20 is opened and the switch 31 is closed, so that a constant duty ratio signal is fed to the comparator 22 from the circuit 32.

Accordingly, a signal having a fixed pulse duty ratio for example 50% is generated from the comparator circuit 22. Thus, the on-off electromagnetic valves 13 and 14 are actuated at a smaller, constant pulse duty ratio. Therefore, the enrichment control is further enhanced.

On the other hand, if a low output voltage of the oxygen sensor 17 continues for the predetermined time, the abnormal condition detecting circuit 27 produces the constant signal to actuate the on-off electromagnetic valves at the constant pulse duty ratio.

Thus, the engine is operated with an extremely rich or lean mixture, which will result in stopping the engine or malfunctioning. However, since the engine is in the idling operation, such an abnormal operation does not have a serious influence on the engine. To the contrary, the malfunction of the carburetor or other parts of the engine is signaled by the abnormal operation.

If the temperature of the oxygen sensor decreases and the output voltage decreases as a result of idling for a long time, the comparator circuit 22 produces a small pulse duty ratio signal for enriching the mixture. If the minimum pulse duty ratio continues for the predetermined time, the switches 20 and 31 operate in the same manner described above. Thus, the on-off electro-magnetic valves 13 and 14 are actuated at the constant pulse duty ratio for preventing an excessive enrichment of the air-fuel mixture.

When the throttle valve 8 is opened (that is idling is completed), the switch 25 is opened, so that the switches 20 and 31 are converted into the state for the normal feedback control. Accordingly, the feedback control circuit 18 operates in response to the signal from the oxygen sensor 17. Therefore, even if the carburetor malfunctions, the mixture is corrected by operation of the feedback control system in dependency on the output of the oxygen sensor 17. Thus, the engine can be operated with the corrected air-fuel mixture. Thus, dangerous or trouble conditions such as stopping of the engine during driving of the vehicle can be avoided.

Figure 5:
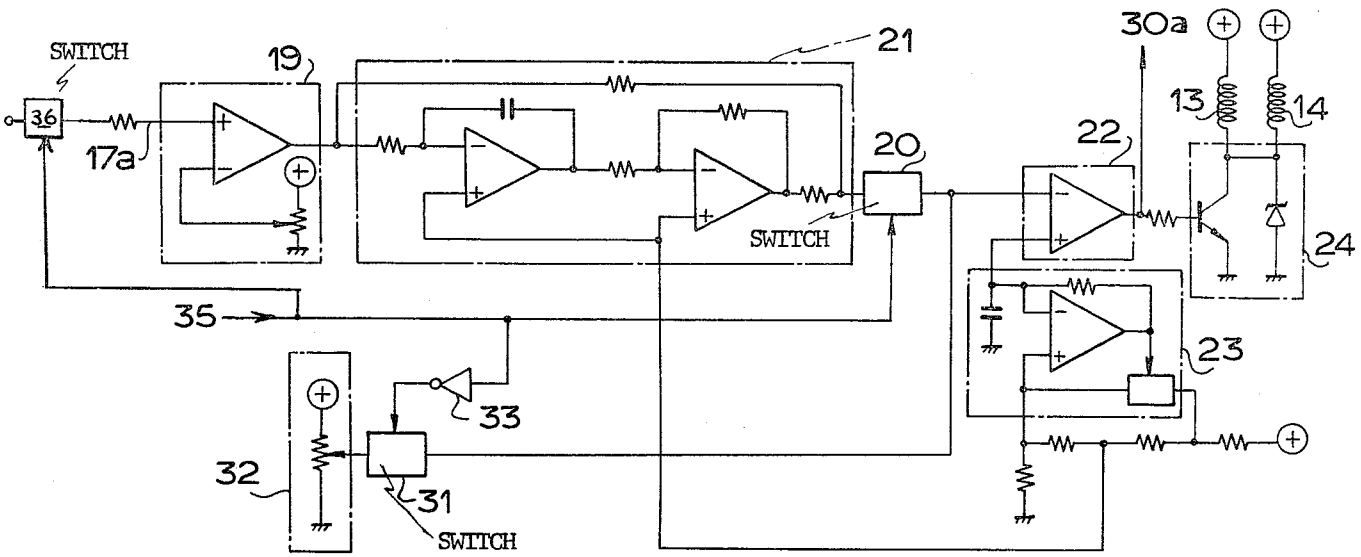
FIGS. 5 and 6 show another control circuit in another embodiment of the present invention.
Figure 6:
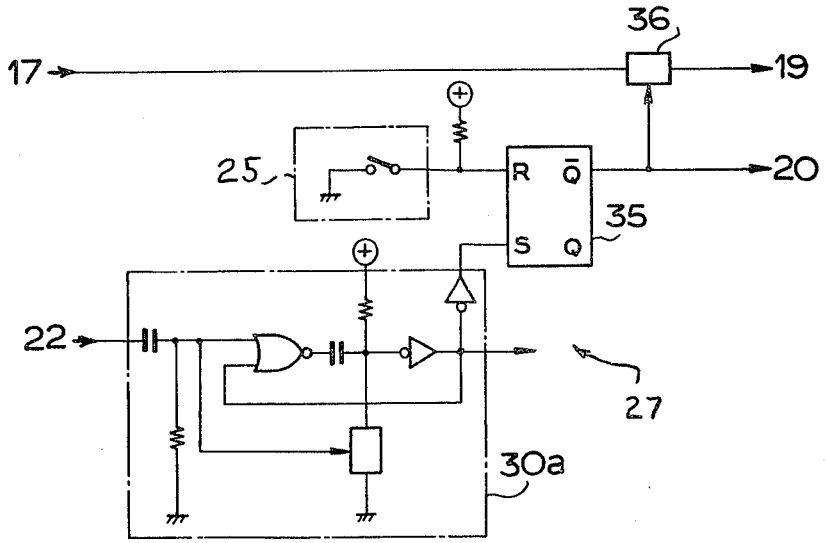

Referring to FIGS. 5 and 6 showing another embodiment of the present invention, the same circuit as the first embodiment is identified by the same reference numerals as the previous embodiment. In this system, the output signal of the comparator 22, that is the square wave pulse train, is fed to a retriggerable monostable multivibrator 30*a*. Outputs of the idling detecting switch 25 and the multivibrator 30*a* are connected to the R input and to the S input of a flip-flop 35, respectively. The $\overline{Q}$ output of the flip-flop 35 is connected to the gate of a switch 36 connecting the oxygen sensor 17 and the comparing circuit 19 and also to the gates of the switches 20 and 31 like the first embodiment.

When the comparator circuit 22 generates the signal of the maximum duty ratio (100% duty ratio) for a predetermined time during the idling operation, the multivibrator 30*a* produces a switch actuating signal, so that the switches 36 and 20 are turned off and the switch 31 is turned on. Thus, the constant signal is fed to the comparator 22. Accordingly, a signal having a fixed duty ratio for example 50% is generated from the comparator 22. Thus, the on-off electromagnetic valves 13 and 14 are actuated at a smaller constant duty ratio.

When the throttle valve 8 is opened, the switch 25 is turned off, so that the output of the flip-flop 35 is changed. Thus, the system is converted to the state for the normal feedback control.

In accordance with the present invention, when an excessive rich or lean air-fuel mixture is supplied due to a malfunction of the engine during the idling operation, the deviation of the air-fuel ratio is further enhanced, which will cause malfunctioning of the engine. Thus, warning of trouble of the engine such as malfunction of the carburetor may be provided. Since the deviation of the air-fuel ratio is corrected during driving the vehicle, engine trouble such as stopping of the engine can be avoided.

What is claimed is:

1. In an air-fuel ratio control system for a carburetor of an internal combustion engine having an intake passage thereof, a throttle valve in the intake passage, an exhaust passage communicating with the engine, first detector means for detecting the concentration of a constituent of exhaust gases passing through said exhaust passage, an on-off electromagnetic valve means for correcting the air-fuel ratio of air-fuel mixture supplied to the intake passage by an air-fuel mixture supply means, the improvement comprising electronic control means comprising a comparator circuit means for comparing an output signal of said first detector means and a driving circuit means for producing a driving output for driving said electromagnetic valve means in dependency on an output signal of said comparator circuit means for controlling the air-fuel ratio to approximately the stoichiometric air-fuel ratio, second detector means for detecting an idling operation of said internal combustion engine and producing an idle detected signal during the idling operation, constant signal generating circuit means for producing a constant signal and when actuated for selectively operating said on-off electromagnetic valve means via said driving circuit means at a predetermined pulse duty ratio, switch means for rendering said electronic control means non-responsive to the output signal of said first detector means and responsive to said constant signal, and abnormal condition detecting circuit means comprising a retriggerable monostable multivibrator responsive to pulses corresponding to an excessive output waveform of said first detector means and for detecting the excessive output waveform when said concentration of the exhaust gases deviates excessively from the stoichiometric air-fuel ratio, said abnormal condition detecting circuit means being retriggered by the pulses to produce one mode of signals for actuating said switch means so as to maintain said electronic control means responsive to the output signal of said first detector means and non-responsive to said constant signal, and to produce another mode of signals for actuating said switch means when one of said pulses continues for a predetermined period under the condition of the production of said idle detected signal, so that the electronic control means is operated by the constant signal for further aggravating the deviation of the air-fuel ratio.

2. The control system according to claim 1, wherein said multivibrator is responsive only to said deviations in said output signal of said first detector means corresponding to a predetermined direction of change in the air-fuel ratio.

3. The control system according to claim 2, wherein said abnormal condition detecting circuit means for being responsive to said excessive output in either direction of deviation of said concentration of the exhaust gases excessively from the stoichiometric air-fuel ratio for generating said signals for actuating said switch means during said excessive output of said first detector means when the excessive output continues for a predetermined period during the idling operation.

4. The control system according to claim 1, wherein said second detector means is an on-off switch actuated by the throttle valve.

5. The control system according to claim 1, wherein said comparator circuit means is for comparing said output signal of said first detector means with a reference signal corresponding to the stoichiometric air-fuel ratio.

6. The control system according to claim 1, wherein said electronic control means includes an integration circuit and a pulse width modulator means coupled serially between said comparator circuit means and said driving circuit means for driving said valve means, said signal generating circuit means is connected to said modulator means, said switch means being interposed between said integration circuit, said modulator means and said signal generating circuit means for selectively interchanging interconnection of said modulator means with said integration circuit and with said signal generating circuit means, respectively, for changing the operation of said control system from a feedback control to an open loop control, respectively, when an abnormal operating condition is sensed by said first detecting means detecting said excessive output for said predetermined period during the idling operation.

7. The control system according to claim 1, further comprising a flip-flop has an R input connected to said second detector means and an S input connected to the output of said multivibrator, another switch means is connected between said first detector means and said comparator circuit means, and an output of said flip-flop is connected to all said switch means.

8. In an air-fuel ratio control system for a carburetor of an internal combustion engine having an intake passage thereof, a throttle valve in the intake passage, an exhaust passage communicating with the engine, first detector means for detecting the concentration of a constituent of exhaust gases passing through said exhaust passage, an on-off electromagnetic valve means for correcting the air-fuel ratio of air-fuel mixture supplied to the intake passage by an air-fuel mixture supply means, the improvement comprising electronic control means comprising a comparator circuit means for comparing an output signal of said first detector means and a driving circuit means for producing a driving output for driving said electromagnetic valve means in dependency on an output signal of said comparator circuit means for controlling the air-fuel ratio to approximately the stoichiometric air-fuel ratio, second detector means for detecting an idling operation of said internal combustion engine and producing an idle detected signal during the idling operation, constant signal generating circuit means for producing a constant signal and when actuated for selectively operating said on-off electromagnetic valve means via said driving circuit means at a predetermined pulse duty ratio, switch means for rendering said electronic control means non-responsive to the output signal of said first detector means and responsive to said constant signal, and abnormal condition detecting circuit means responsive to an excessive output of said first detector means, the excessive output being detected when said concentration of the exhaust gases deviates excessively from the stoichiometric air-fuel ratio, and to said idle detected signal during the idling operation, said abnormal condition detecting circuit means including a delay circuit for generating signals for actuating said switch means during said excessive output of said first detector means when the excessive output continues for a predetermined period during the idling operation, so that the electronic control means is operated by the constant signal for further aggravating the deviation of the air-fuel ratio, said electronic control means includes an integration circuit and a pulse width modulator means coupled serially between said comparator circuit means and said driving circuit means for driving said valve means, said signal generating circuit means is connected to said modulator means, said switch means being interposed between said integration circuit, said modulator means and said signal generating circuit means for selectively interchanging interconnection of said modulator means with said integration circuit and with said signal generating circuit means, respectively, for changing the operation of said control system from a feedback control to an open loop control, respectively, when an abnormal operating condition is sensed by said first detecting means detecting said excessive output for said predetermined period during the idling operation, said delay circuit includes a monostable multivibrator having an input connected to an output of said modulator means, a flip-flop has an R input connected to said second detector means and an S input connected to the output of said multivibrator, another switch means is connected between said first detector means and said comparator circuit means, and an output of said flip-flop is connected to all said switch means.

9. In an air-fuel ratio control system for a carburetor of an internal combustion engine having valve means for adjusting the air-fuel ratio, the improvement comprising first detector means for detecting the concentration of a constituent of exhaust gases of said engine, electronic control means responsive to an output signal of said first detector means and including driving circuit means for driving said valve means to adjust the air-fuel ratio, second detector means for detecting an idling operation of said engine and producing an idling detection signal, signal generating circuit means for operating said valve means at a fixed rate of operation, switch means operatively coupled to said electronic control means and said signal generating circuit means for selectively coupling said electronic control means and said signal generating circuit means to said valve means, and abnormal condition detecting means coupled to said switch means for operating said switch means, said abnormal condition detecting means being responsive to said idling detection signal of said second detector means and to an output signal of said first detector means for said operating of said switch means, said abnormal condition detecting means including a delay circyit for delaying the operation of said switch means until a predetermined delay time has elapsed after a detected excessive change in the air-fuel ratio of said exhaust gases as sensed by said first detector means, said electronic control means includes an integration circuit and a pulse width modulator means coupled serially between said comparator circuit means and said driving circuit means for driving said valve means, said signal generating circuit means is connected to said modulator means, said switch means being interposed between said intergration circuit, said modulator means and said signal generating circuit means for selectively interchanging interconnection of said modulator means with said integration circuit and with said signal generating circuit means, respectively, for changing the operation of said control system from a feedback control to an open loop control, respectively, when a abnormal operating condition is sensed by said first detecting means detecting said excessive output for said predetermined period during the idling operation, said delay circuit includes a monostable multivibrator having an input connected to an output of said modulator means, a flip-flop has an R input connected to said second detector means and an S input connected to the output of said multivibrator, another switch means is connected between said first detector means and said comparator circuit means, and an output of said flip-flop is connected to all said switch means.

* * * * *